United States Patent [19]

Hodges

[11] Patent Number: 4,718,728

[45] Date of Patent: Jan. 12, 1988

[54] HYDRAULIC COUPLE ROTATIONAL FORCE HYDRAULIC MINING TOOL APPARATUS

[76] Inventor: Everett L. Hodges, 49 Royal St. Gerorge, Newport Beach, Calif. 92660

[21] Appl. No.: 857,093

[22] Filed: Apr. 29, 1986

Related U.S. Application Data

[63] Continuation of Ser. No. 631,864, Oct. 5, 1984, abandoned, which is a continuation of Ser. No. 419,230, Sep. 17, 1982, abandoned.

[51] Int. Cl.[4] ..... E21C 45/00

[52] U.S. Cl. ..... 299/17; 175/67

[58] Field of Search ..... 299/17; 175/67, 107, 175/317, 215

[56] References Cited

U.S. PATENT DOCUMENTS

| | | | |
|---|---|---|---|
| 3,316,985 | 5/1967 | Fly | 175/24 |
| 3,797,590 | 3/1974 | Archibald et al. | 299/17 X |
| 3,804,182 | 4/1974 | Adair et al. | 175/237 X |
| 3,951,457 | 4/1976 | Redford | 299/17 X |
| 4,074,779 | 2/1978 | Cheung et al. | 175/317 X |
| 4,212,353 | 7/1980 | Hall | 299/17 X |
| 4,273,201 | 6/1981 | Garrett | 175/107 |
| 4,296,970 | 10/1981 | Hodges | 299/17 X |
| 4,302,052 | 11/1981 | Fischer | 299/17 X |

*Primary Examiner*—Stephen J. Novosad

*Assistant Examiner*—David J. Bagnell

*Attorney, Agent, or Firm*—Stetina and Brunda

[57] ABSTRACT

An improved hydraulic mining tool apparatus for recovering minerals such as tar sands and the like from subterranean formations is disclosed, wherein plural cutting jet nozzles, adapted to hydraulically dislodge mineral particles from the formation are positioned to generate a hydraulic couple rotational force upon the mining tool and thereby reduce overall power requirements for the apparatus. The plural cutting jet nozzles are connected to one or more flow conduits extending axially within the mining tool apparatus or alternatively may extend from a common sealed reservoir formed within the annulus of the mining tool. The present invention additionally discloses the use of a tri-cone cutting bit assembly positioned upon the lowermost end of the apparatus which may be activated and de-activated from ground surface to selectively provide a rock crushing and force-feeding of mined material during operation as well as during the lowering of the mining tool into the mineral formation. The mining tool apparatus further incorporates one or more tool casing extensions, selectively mountable between the tri-cone cutting bit assembly and the slurry inlets of the tool to insure that the slurry inlets remain clear from rock obstructions accumulating about the lowermost portion and tri-cone bit assembly of the tool during the mining operation.

5 Claims, 8 Drawing Figures

Fig. 3
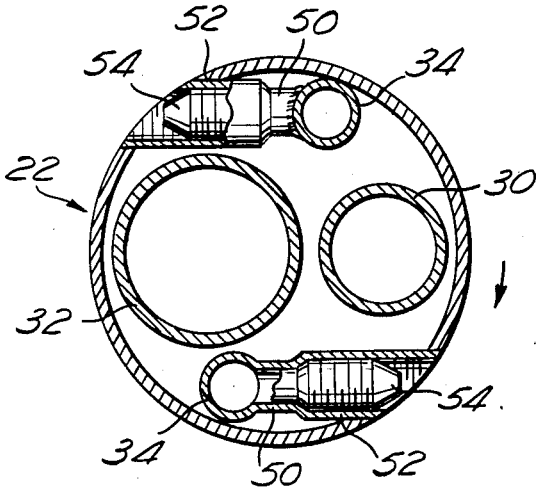
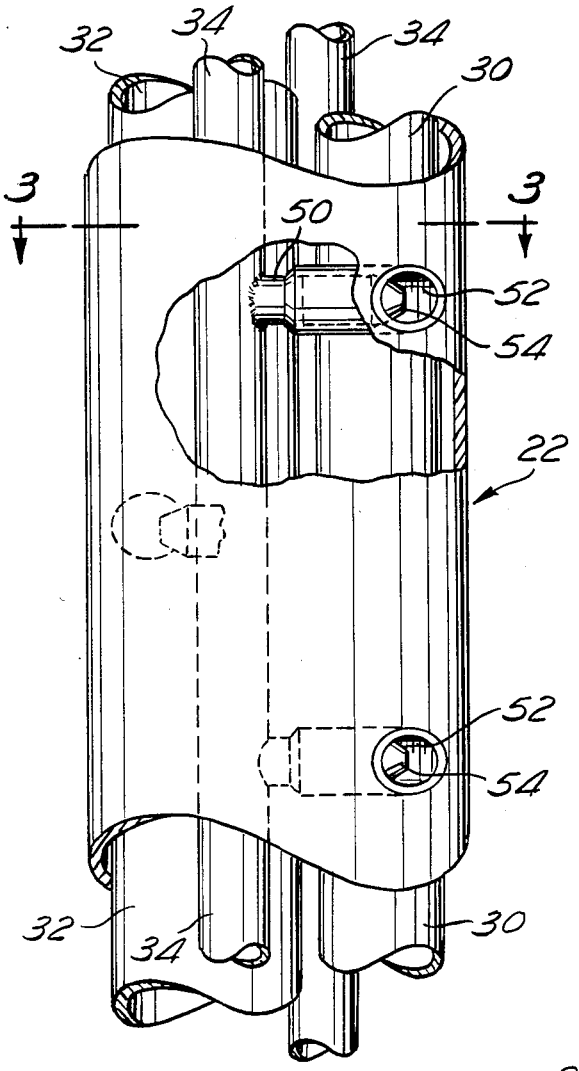
Fig. 4
Fig. 5
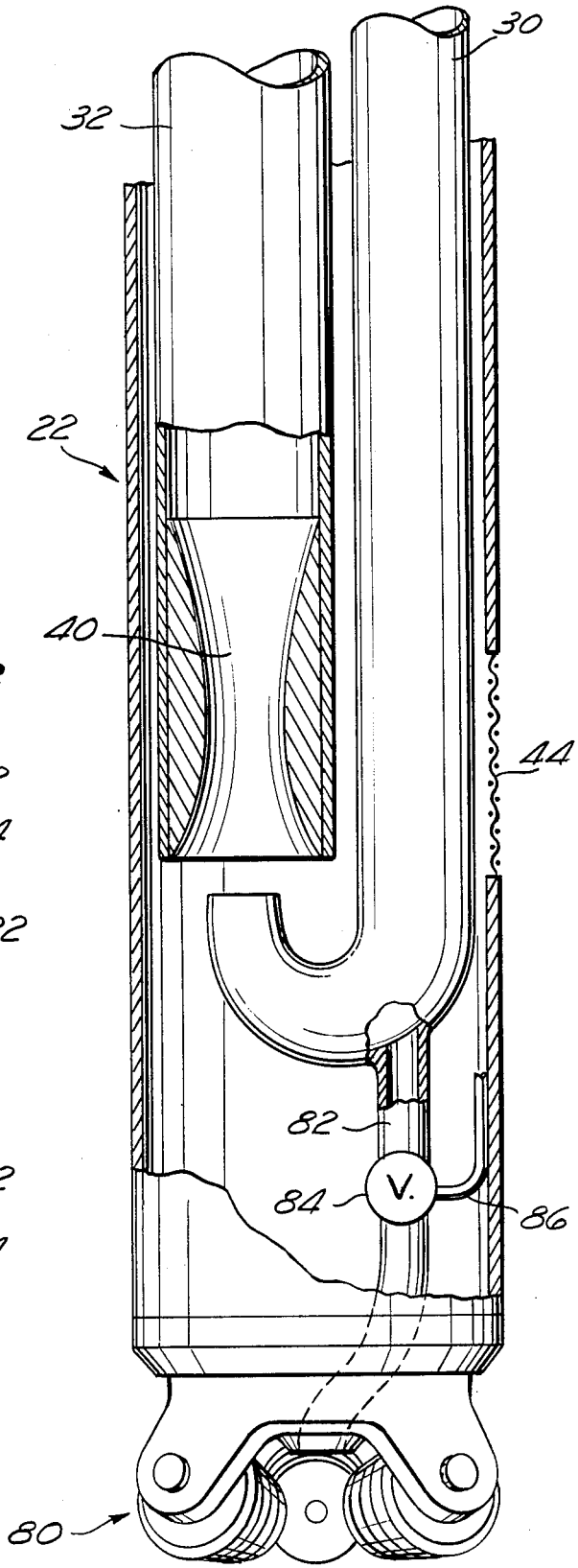

HYDRAULIC COUPLE ROTATIONAL FORCE HYDRAULIC MINING TOOL APPARATUS

This application is a continuation, of application Ser. No. 631, 864 filed Oct. 5, 1984 now abandoned, which is a continuation of Ser. No. 419,230 filed Sept. 17, 1982 now abandoned.

BACKGROUND OF THE PRESENT INVENTION

The present invention relates generally to hydraulic mining tool apparatus and, more particularly, to an improved hydraulically mining tool apparatus for recovering minerals such as tar sands, from subterranean formations wherein a plurality of cutting jet nozzles adapted to hydraulically dislodge mineral particles from the formation are positioned to generate a hydraulic couple self-rotational force upon the mining tool and thereby reduce overall input power requirements for the apparatus.

The present invention further relates to and improves upon my previous filed U.S. patent applications Ser. No. 053,029 entitled "Downhole Pump Bottom Receptor," now issued U.S. Pat. No. 4,275,926; Ser. No. 121,712 entitled "Hydraulic Mining Tool Apparatus" now issued U.S. Pat. No. 4,296,970; and my copending patent applications Ser. No. 231,495 entitled "Apparatus and Method of Hydraulically Mining Subterranean Mineral Formations;" Ser. No. 232,439 now U.S. Pat. No. 4,415,206, entitled "Improved Drill String and Method of Hydraulically Mining Mineral Formations;" and Ser. No. 253,681, now U.S. Pat. No. 4,420,187, entitled "Stationary Drill String Hydraulic Mining Tool Apparatus.

Basically, the operation of such hydraulic mining tool apparatus is characterized by the use of a high velocity liquid stream which is discharged directly into the subterranean mineral formations to dislodge minerals from their surrounding mineral bed. The freed minerals form a resultant slurry with the discharged liquid stream which may be pumped by various means, upward to ground surface and subsequently processed by surface separation equipment. As the slurry is removed from the formation, a mining cavity or void is formed in the mineral bed which may extend to fifty to a hundred feet in diameter throughout the height of the mineral bed. The use of such hydraulic mining tool recovery operation is extremely suited for many mineral formations such as tar sands, which typically are located at vertical depths sufficiently below ground surface to prohibit strip mining recovery techniques while sufficiently close to ground surface to prohibit conventional mineral mining operations.

A constant cause of concern existing within the hydraulic mining tool technology has been the occurrence of a compaction or cave-in situation within the formation whereby the surrounding mineral bed catastrophically falls in and around the drill string of the mining tool during operation. As will be recognized, when such a compaction situation occurs, the weight force exerted upon the mining tool generates an extremely large torsional drag upon the mining tool. As such, the prior art mining tools have heretofore incorporated relatively large ground surface mechanisms to effectuate continuous rotation of the mining tool within the formation and have utilized high torsional strength connections along the length of the mining tool and drill string to insure against a twist-off condition resulting in the mining tool being irretrievably lost within the mineral formation. As will be recognized, the use of such relatively large rotating mechanisms has added substantially to the overall operating costs involved in recovering minerals from the formation while the purposeful engineering of high torsional strength connections along the mining tool and drill string has increased the initial capital investment costs of the mining tool apparatus.

In addition, the prior art hydraulic mining tool apparatus has typically utilized only a single hydraulic cutting jet nozzle to direct the hydraulic jet flow radially outward into the formation from the central axis of the tool. In such mining tools, the reactionary force generated by the discharge of the high velocity fluid has the potential to cause axial deflection of the tool and drill string during operation. Heretofore, the only attempts to alleviate these axial bending problems have been the intentional overdesign of the tool to be capable of resisting the same. As such, the costs of the prior art mining tools have been prohibitive.

A further deficiency of the prior art hydraulic mining tools has been their propensity of having their slurry inlet openings becoming obstructed by rocks and other formations debris during the mining process. When such rock debris accumulates adjacent the inlet openings, the amount of mined minerals slurry entering into the tool is substantially reduced, which therefore reduces the overall efficiency of the hydraulic mining process. Although this problem has been addresed to a limited extent in the prior art by providing the slurry inlet openings with screens adapted to prevent rock and the like from entering into the interior of the tool, the location of the screens and slurry inlets have typcially been proximate the lower end of the mining tool and have themselves been subject to becoming obstructed by large rock debris in the formation.

Thus, there exists an inherent need in the field for an improved hydraulic mining tool apparatus which reduces the power requirements of the rotating mechanism, minimizes cutting jet reactionary bending forces exerted upon the tool and permits the tool to be operated for prolonged duration without obstruction of the slurry inlet openings.

SUMMARY OF THE PRESENT INVENTION

The present invention specifically addresses and alleviates the above-referenced deficiencies associated in the art by providing an improved hydraulic mining tool apparatus wherein a hydraulic cutting jets are positioned to generate a hydraulic couple self-rotational force on the tool which additionally reduces the bending forces applied to the mining tool. In the preferred embodiment, the plural cutting jet nozzles are connected to either a common flow conduit extending axially from above ground surface within the interior of the mining tool apparatus or alternatively, may extend from a sealed reservoir formed within the annulus of the mining tool. Further, each of the cutting jet nozzles may be provided with a replaceable nozzle insert, which permits the size and/or angular direction of the nozzles to be adjusted prior to insertion of the tool within the formation. Similarly, the use of the nozzle insert design of the present invention permits one or more of the nozzles to be capped or plugged off thereby permitting the tool to be finally adjusted to meet the particular physical composition of the mined mineral bed.

The present invention additionally discloses the use of a tri-cone cutting bit assembly which is mounted upon the lowermost end of the apparatus to provide a rock crushing and force-feeding effect of mined material into the mining tool during the mining operation. Advantageously, the tri-cone cutting bit assembly is controlled by a valve mechanism which may be adjusted from ground surface to selectively initiate or de-activate the operation of the same.

Further, the present invention discloses the use of plural tool casing extensions which are mountable between the tri-cone cutting bit assembly and the slurry inlet of the tool. By utilizing one or more of these casing extensions, a sufficient distance between the tri-cone cutting bit and slurry inlets of the tool is maintained which permits a substantial amount of accumulation of rock debris and the like adjacent the lower portion of the tool without obstruction of the slurry inlet openings. Additionally, each of the casings segments include a hollow interior to permit crushed particulate matter generated from the tri-cone cutting bit to travel axially upward toward the pumping mechanism of the mining tool.

DESCRIPTION OF THE DRAWINGS

These as well as other features of the present invention will become more apparent upon reference to the drawings wherein:

FIG. 3 is an enlarged cross sectional view taken about lines 3—3 of FIG. 4 and illustrating the construction and positioning of the multiple hydraulic cutting jets which generate the hydraulic couple/self-rotational force;

FIG. 4 is an enlarged partial perspective view illustrating the axial spacing of the multiple hydraulic cutting jets of the present invention;

FIG. 5 is an enlarged cross sectional view of the hydraulic mining tool of the present invention depicting the valve control mechanism for the tri-cone cutting bit assembly;

DETAILED DESCRIPTION OF THE PREFERRED EMBODIMENT

Figure 1:
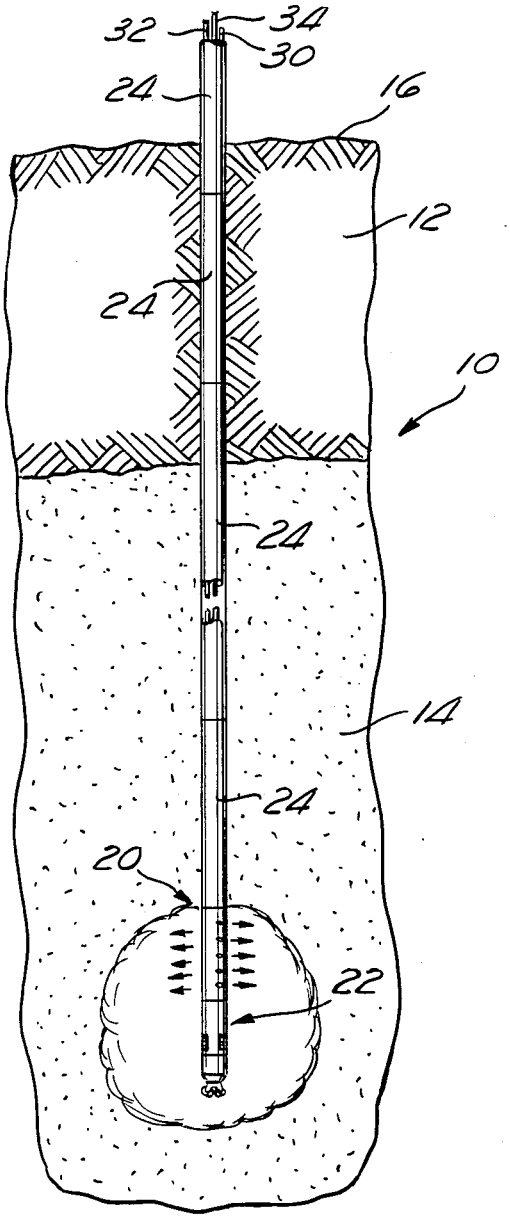
FIG. 1 is a perspective view of the hydraulic mining tool apparatus of the present invention depicted in an actual mining process being disposed within a borehole extending from ground surface through overburden and into a mineral bed.

Referring to FIG. 1, there is shown a mineral deposit 10 composed of an overburden 12 and mineral bed 14 (such as tar sands) which is being mined by the improved hydraulic tool apparatus 20 of the present invention. The mining tool apparatus 20 is composed of a plurality of drill sections 24 which are connected in an axial end to end orientation extending from the mineral bed 14 upward to ground surface 16, and a hydraulic mining tool designated generally by the numeral 22 mounted at the lowermost end of the drill sections. A jet pump supply conduit 30, jet pump eductor conduit 32, and one or more cutting jets supply conduits 34 extend axially within the interior of the drill sections 22, initiating from a height above ground surface 16 and terminating within the mining tool 22.

The jet pump supply conduit 30 and cutting jet supply conduits 34 are connected to suitable piping (not shown) to supply a high volume, high pressure fluid flow from ground surface 16 downward through the drill sections 24 and into the mining tool 22. The fluid flow through the cutting jet supply conduits 34 is discharged outward from the mining tool 24 to dislodge minerals from the mineral bed 14 (as depicted by the arrows in FIG. 1) and form an aqueous mineral slurry while the discharge from the jet pump supply conduit 30 is directed upward through a venturi orifice 40 (shown in FIG. 5) positioned at the lowermost end of the eductor conduit 32. As the liquid is discharged upward through the venturi orifice 40, suction is developed below the venturi orifice 40 which serves to pull the mined mineral slurry into the eductor conduit 32 through one or more screened slurry inlets 44 positioned on the mining tool 22 for transfer upward to ground surface 16. Upon transport to ground surface 16, the mineral slurry may be subsequently processed by various separation systems.

Figure 2:
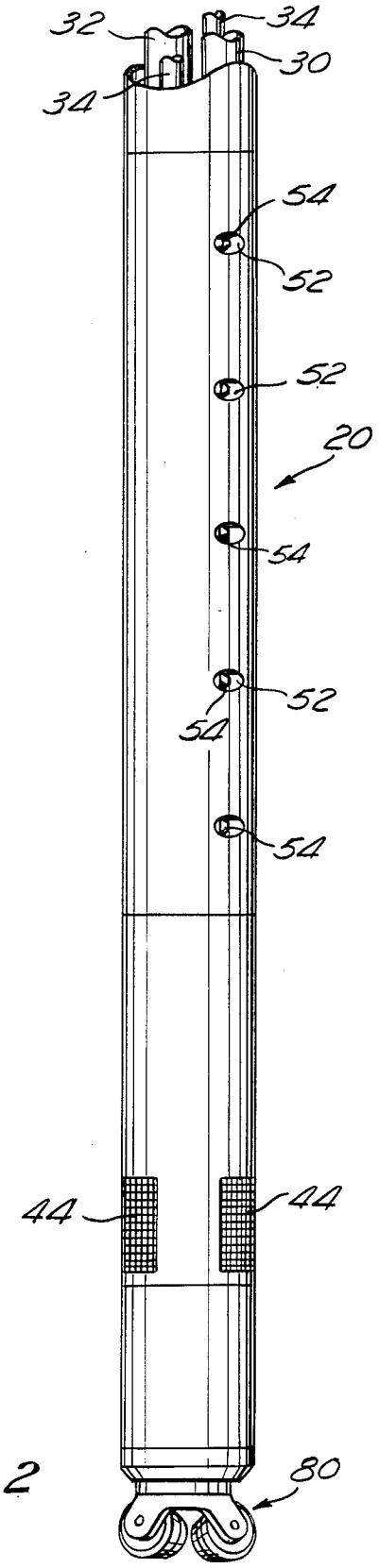
FIG. 2 is an enlarged perspective view of the mining tool apparatus of the present invention illustrating the relative position of the multiple cutting jets, slurry inlets, and tri-cone cutting bit assembly.

In contrast to the prior art mining tool apparatus, the mining tool 22 of the present invention includes a novel cutting jet design which is depicted in FIGS. 2 through 4. As shown, the cutting jet supply conduits 34 extend axially downward within the interior of the mining tool 22 terminating at an elevation above the jet pump venturi orifice 40. Each of the supply conduits 34 is provided with one or more discharge conduits 50 which are preferably vertically spaced from one another and extend outward in opposite generally parallel directions through the interior of the mining tool 22. As best shown in FIG. 3, the distal portion 52 of each of the discharge conduits 50 is formed having an inside discharge conduit 50 and is sized to threadingly receive a nozzle insert 54. Each of the nozzle inserts 54 may be formed having varying-sized central apertures to vary the volume and/or velocity of fluid being discharged through the nozzles 54 and additionally may be formed such that its central aperture is directed at an angular inclination to the central axis of the nozzle to vary the direction of fluid discharge through the nozzle 54. In addition, due to the nozzle inserts 54 being threadedly received within the enlarged portion 52 of the discharge conduit 50, each of the nozzle inserts 54 may be replaced by a suitable plug (not shown) to prevent any discharge through one or more of the discharge conduits 50.

In operation, high pressure fluid carried within the cutting jet supply conduits 34 exits through each of the discharge conduits 50 and subsequently through the nozzle inserts 54 wherein a plurality of high velocity hydraulic cutting jets are discharged into the mineral bed formation 14 to dislodge minerals from the bed 14 and form an aqueous mineral bearing slurry. Due to the discharge from the nozzle inserts 54 being arranged in opposite but generally parallel directions, a hydraulic couple force is generated about the central axis of the mining tool 22 which yields a self-rotational couple reactionary force about the mining tool 22 in a clockwise direction as indicated by the arrow in FIG. 3.

Thus, during the mining operation when fluid is discharged through the plural nozzle inserts 54, the power requirements for the above-ground rotating mechanism (not shown) utilized to effectuate a rotation of the mining tool 22 in the mineral bed 14 are substantially reduced. Further, due to the fluid discharge through the plural nozzles 54 occurring in a generally equal magnitude in opposite parallel directions, the hydraulic reactionary force of the liquid discharge through each of the nozzles 54 is basically offset, thereby eliminating the bending forces heretofore associated in the operation of hydraulic mining tools.

Figure 7:
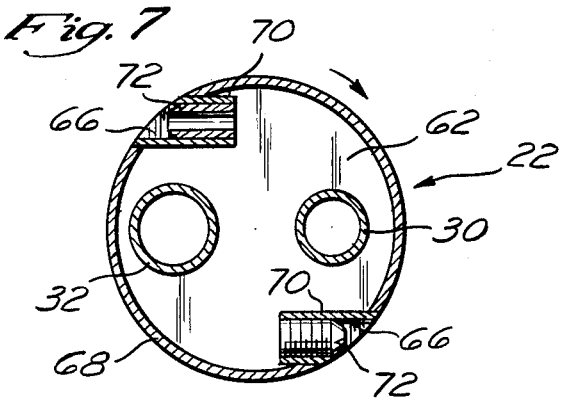
FIG. 7 is a cross sectional view taken about lines 7—7 of FIG. 6.
Figure 6:
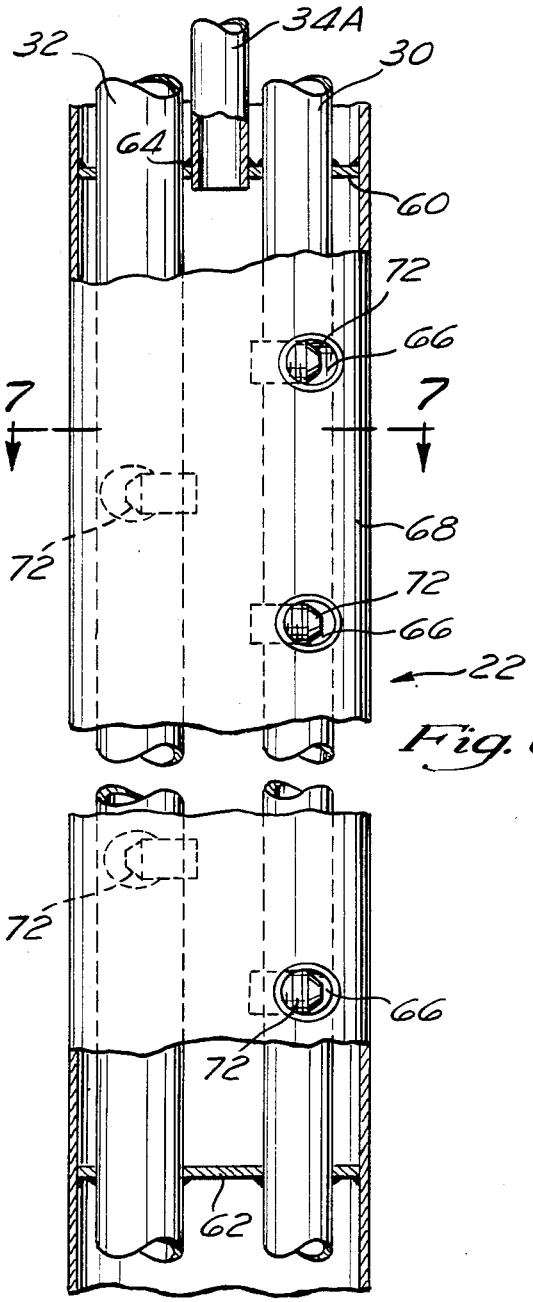
FIG. 6 is a partial perspective view of an alternative embodiment of the multiple cutting jets of the present, invention, each extending from a common reservoir formed within the annulus of the mining tool.

An alternative embodiment of the self-rotational hydraulic couple force features of the present invention is depicted in FIGS. 6 and 7. In contrast to the embodiment depicted in FIGS. 3 and 4, in this alternative embodiment, the pair of cutting jet supply conduits 34 are replaced by a single jet supply conduit 34A which terminates at the upper portion of the mining tool 22. As best shown in FIGS. 6, the upper portion of the hydraulic mining tool 22 in this alternative embodiment, is segregated from the remaining portion of the mining tool 20 by a pair of end plates 60 and 62 which are rigidly attached about their circumference as by a filet weld to the interior surface of the mining tool 22. The cutting jet supply conduit 34A extends a short distance through the upper and plate 60 and is sealed thereto as by a filet weld 64, while the jet pump supply conduit 30 and eductor condut 32 extend through both of the end plates 60 and 62 and are sealed there again as by a similar filet weld. Thus, by such a structure, it will be recognized that the interior or annular portion of the mining tool 22 between the end plates 60 and 62 forms a storage reservoir for liquid being supplied from the cutting jet conduit 34A.

A plurality of apertures 66 are formed through the casing 68 of the mining tool 22 which as in the embodiment of FIGS. 3 and 4, are arranged in a vertically spaced generally parallel orientation to permit fluid discharge from the reservoir in opposite but generally parallel directions. As best shown in FIG. 7, each of the apertures 66 includes a sleeve 70 rigidly attached to the casing 68, which extends a short distance inward to reside within the reservoir. The interior diameters of the sleeves 70 are threaded to mate with a respective nozzle insert 72 which are adapted to direct a high velocity liquid discharge from the reservoir outward into the mineral bed 14.

In operation, high pressure liquid is discharged through the cutting jet supply conduit 34A into the reservoir formed between the end plate 60 and 62 and is subsequently discharged through the plural nozzle insert 72 to dislodge minerals from the mineral bed 14. During this discharge, a hydraulic couple or dynamic rotational force is generated which as in the embodiment of FIG. 3 and 3, serves to provide a self-rotational counter clockwise force as indicated by the arrow in FIG. 7.

To augment the improved self-rotational feature, the present invention additionally incorporates a tri-cone cutting bit assembly 80 positioned upon the lowermost end of the mining tool 22 which may be activated and de-activated from ground surface 16 to selectively provide a rock-crushing effect of mined material during the mining operation. The construction and operation of the tri-cone cutting bit assembly 80 is depicted in FIG. 5.

As is well known, the tri-cone cutting bit assembly 80 includes three conical shaped members which rotate in opposition to one another to provide a grinding or cutting effect within the mineral bed 14. The assembly 80 is powered by fluid flow tapped from the jet pump supply conduit 30 as by way of a tri-cone supply conduit 82 extending within the interior of the mining tool 22. A valve 84 is additionally provided upon the tri-cone cutting bit supply conduit 82 which may be activated by conventional means such as an auxiliary pressure port 86 from above ground surface 16 to either initiate or discontinue fluid flow to the tri-cone cutting bit assembly 80.

When it is desired to lower the hydraulic mining tool 22 downward within the mineral bed 14, the valve 84 may be activated to an open position whereby high pressure fluid flow entering the mining tool 22 through the jet pump supply conduit 30 is applied to the tri-cone cutting bit assembly through the cutting bit conduit 82. During operation, the mineral bed 14 located directly below the tri-cone cutting bit assembly 80 is ground and/or drilled in a conventional manner with any hard rock particles being sufficiently reduced in size to permit the mining tool 22 to be lowered downward into the formation 14.

When the mining tool 22 has been lowered to a desired depth, the valve 84 may be returned to a closed position, whereby the entire volume of liquid being discharged through the jet pump supply conduit 30 is directed upward through the venturi orifice 40 to return the aqueous mineral slurry mined from the mineral bed 14 to ground surface 16. Thus, it will be recognized that by use of the tri-cone cutting bit assembly 80 and its valve arrangement 84, the hydraulic mining tool 22 of the present invention may be easily lowered in a desired elevation within the mineral bed 14 while insuring that maximum pumping efficiencies are maintained when the tri-cone cutting bit assembly 80 is not being utilized.

Figure 8:
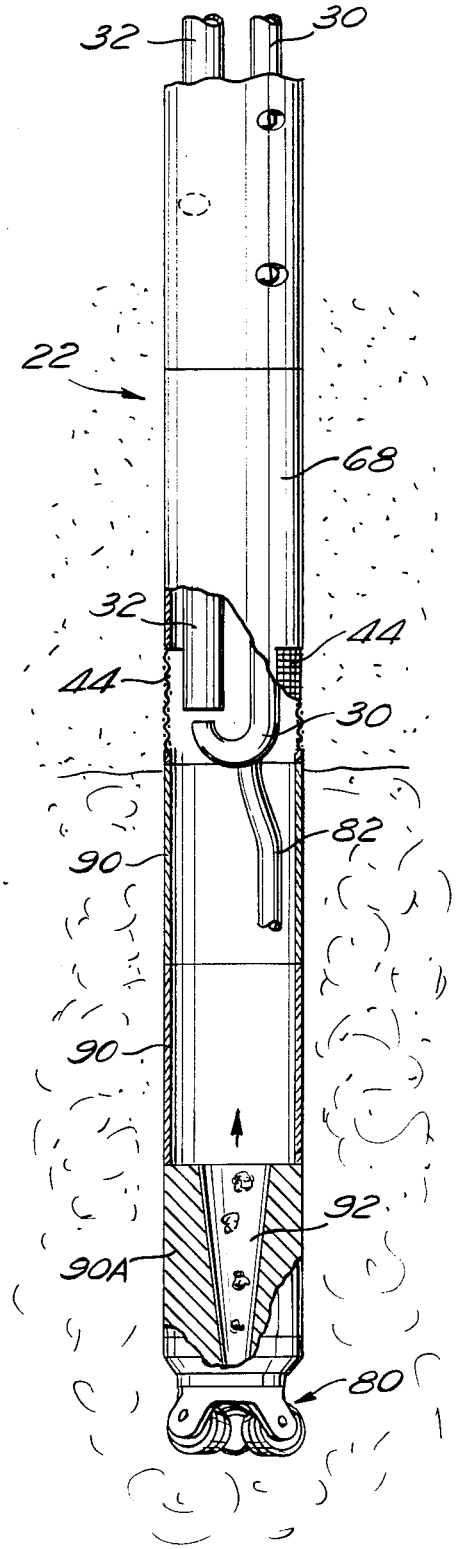
FIG. 8 is a partial perspective view of the hydraulic mining tool of the present invention depicting the multiple casing extensions disposed between the tri-cone cutting bit assembly and slurry inlets of the tool.

The present invention additionally incorporates a mechanism and structure for reducing the propensity of the slurry inlet openings 44 of the mining tool 22 from becoming blocked or obstructed during the hydraulic mining operation. The detailed structure to effectuate this desired result is depicted in FIG. 8 and comprises a plurality of tool casing extensions 90 which may be positioned between the tri-cone cutting bit assembly 80 and the slurry inlet openings 44 of the mining tool 22. The tool casings 80 are preferably formed as cylindrical tubes, having an outside diameter equal or slightly less than the outside diameter of the casing 68 of the mining tool 22. As best shown in FIG. 8, the extensions 90 may be connected into an end to end orientation and mounted to the mining tool 22 to increase the vertical spacing or separation between the tri-cone cutting bit assembly 80 and the slurry inlet 44 of the mining tool 22. Thus, as rock and other formation debris accumulates adjacent the lower portion of the mining tool 22 during the hydraulic mining tool operation, the slurry inlets 44 of the mining tool 22 are maintained vertically above the rock accumulation and thereby remain substantially free and unobstructed for prolonged duration. Hence, the mined mineral slurry is free to enter into the inlets 44 of the mining tool 22 and be transported upward through the eductor conduit 32 to ground surface 16.

Advantageously, the lowermost extension 90A which is mounted to the tri-cone cutting bit assembly 80, may include a reduced diameter central passage 92 preferably formed in a conical shaped configuration. The inside diameter of the lowermost end of the aperture 92 is preferably sized to be slightly less than the minimum diameter of the venturi orifice 40 of the eductor conduit 32 while the uppermost end of the aperture 92 may be formed in any larger convenient size. Thus, by use of the conical shaped aperture 92, mineral and/or rock particles may enter from the lowermost end of the mining tool 22 during operation and travel through the conical shaped aperture 92 and axially upward within the interior of the extensions 90 for subsequent travel through the eductor conduit 32. Therefore, as rock particles accumulate under the mining tool 22 and are reduced in size by the tri-cone cutting bit assembly 80, they may be removed from the area beneath the mining tool 22 and thereby retard the rate of accumulation of the same.

Thus, in summary, the present invention comprises a significantly improved hydraulic mining tool which generates a self-rotational hydraulic couple force during operation, incorporates a tri-cone cutting bit attachment which may be activated and de-activated from the ground surface to permit the lowering of the mining tool within the mineral bed formation, and includes plural tool extensions which serve to insure that the slurry inlets for hydraulic mining tool remain free and unobstructed during prolonged operation. Although for purposes for illustration, the preferred structure has been recited herein, those skilled in the art will recognize that various structural modifications may be made without departing from the spirit of the present invention.

What is claimed is:

1. An improved hydraulic mining tool apparatus for recovering minerals from a subterranean deposit comprising:

a drill string formed to extend from ground surface into said subterranean deposit;

a mining tool mounted on one end of said drill string to be disposed within said subterranean deposit;

a cutting jet comprising at least a pair of nozzles mounted on said mining tool for discharging fluid into said subterranean deposit to dislodge minerals from said deposit and form an aqueous mineral bearing slurry, said at least a pair of nozzles positioned to direct fluid flow in opposite and generally parallel directions outward from said mining tool to generate a reactionary rotational force about the axis of said mining tool;

a cutting jet supply conduit for communicating fluid, separate and independently from ground surface through said drill string to the cutting jet;

a cutting bit mounted on one end of said mining tool for cutting into said subterranean mineral formation, said cutting bit discharging fluid in order to aid said cutting;

a jet pump eductor conduit having one end disposed upon said mining tool for communicating fluid and said aqueous mineral bearing slurry through said drill string to ground surface;

a jet pump supply conduit for communicating fluid separately and independently from ground surface through said drill string to both said cutting bit and said jet pump eductor conduit;

said cutting jet supply conduit including a common high pressure flow reservoir formed within the interior volume of the mining tool; and wherein said at least a pair of nozzles each communicate with the common high pressure flow reservoir formed within the interior of said mining tool.

2. The hydraulic mining tool apparatus of claim 1 wherein said at least a pair of nozzles is spaced from one another along the axial length of said mining tool.

3. The hydraulic mining tool apparatus of claim 1 wherein said cutting bit comprises a tri-cone cutting bit.

4. The hydraulic mining tool apparatus of claim 1 further comprising valve means for selectively actuating and de-actuating flow communication from said jet pump supply conduit to said cutting bit.

5. The hydraulic mining tool apparatus of claim 1 further comprising:

an inlet formed on said mining tool for permitting said aqueous mineral bearing slurry to travel toward said jet pump eductor conduit; and an extension mounted between said inlet and said cutting bit to axially space said inlet from said cutting bit.

* * * * *